United States Patent [19]

Kaupp

[11] 3,938,476

[45] Feb. 17, 1976

[54] TUBE SUPPORT

[75] Inventor: Robert F. Kaupp, Willow Grove, Pa.

[73] Assignee: Selas Corporation of America, Dresher, Pa.

[22] Filed: Dec. 30, 1974

[21] Appl. No.: 537,435

[52] U.S. Cl. ..... 122/510; 122/356

[51] Int. Cl.[2] ..... F22B 37/24

[58] Field of Search ..... 122/333, 356, 510; 23/277 R, 288 R; 196/98, 116

[56] References Cited

UNITED STATES PATENTS

| | | | |
|---|---|---|---|
| 3,240,204 | 3/1966 | Wiesenthal | 23/277 X |
| 3,385,269 | 5/1968 | Breckenridge | 122/356 X |
| 3,385,271 | 5/1968 | Fleischer | 122/510 |
| 3,492,973 | 2/1970 | Benkert et al. | 122/510 |
| 3,552,362 | 1/1971 | Francis | 122/510 |
| 3,630,176 | 12/1971 | Sato et al. | 122/356 |

*Primary Examiner*—Kenneth W. Sprague

[57] ABSTRACT

The invention relates to a means for supporting a tube in a tube heater in such a manner that the tube can move bodily and the convolutions thereof can move individually.

3 Claims, 2 Drawing Figures

TUBE SUPPORT

BACKGROUND AND SUMMARY OF THE INVENTION

The present invention relates to tube heaters such as those used in the petrochemical industry, and more particularly to mechanism for supporting the tube in such a heater. One type of tube that is used is in the form of a plurality of convolutions. As the fluid flows through the tube its temperature is raised, thus causing the tube to expand. Since this expansion is uneven from end to end of the tube some means must be provided to permit the convolutions of the tube to expand without setting up undue strains therein. Some operations require that the tubes discharge into a quench immediately adjacent to the point where the tube exits from the heater. Such a quench is fixed to a rigid support but, depending upon the type of mounting used, may also be subjected to expansion and contraction that is transferred to the tube.

It is an object of the invention to provide a mechanism for mounting a coil in a tube heater. It is a further object of the invention to provide means to mount a convoluted tube coil so that the convolutions thereof can move relative to each other.

In the apparatus, as disclosed, a tube is located in a heater midway between the walls thereof. The discharge end of the tube is rigidly attached to a quench while the entrance end is supplied from a source outside the heater. Between these points the tube is formed of a plurality of vertically extending convolutions each of which is independently supported. The supports are such that the entire tube can be moved vertically when this is required by expansion of the quench. The flexibility of the support means insures that no part of the tube will be subjected to undue strain.

The various features of novelty which characterize my invention are pointed out with particularity in the claims annexed to and forming a part of this specification. For a better understanding of the invention, however, its advantages and specific objects attained with its use, reference should be had to the accompanying drawings and descriptive matter in which I have illustrated and described a preferred embodiment of the invention.

IN THE DRAWINGS

FIG. 1 is a sectional view through a heater showing a coil and its supports, and FIG. 2 is a section taken on a line 2—2 of FIG. 1.

DETAILED DESCRIPTION

Figure 2:
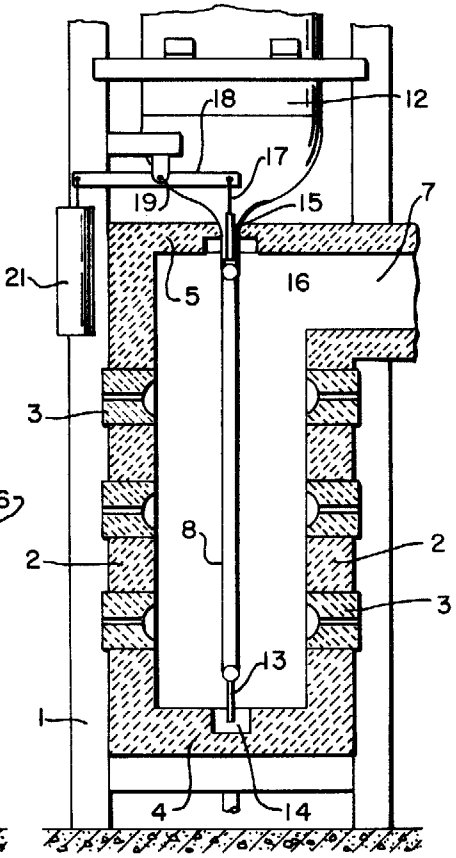
Figure 1:
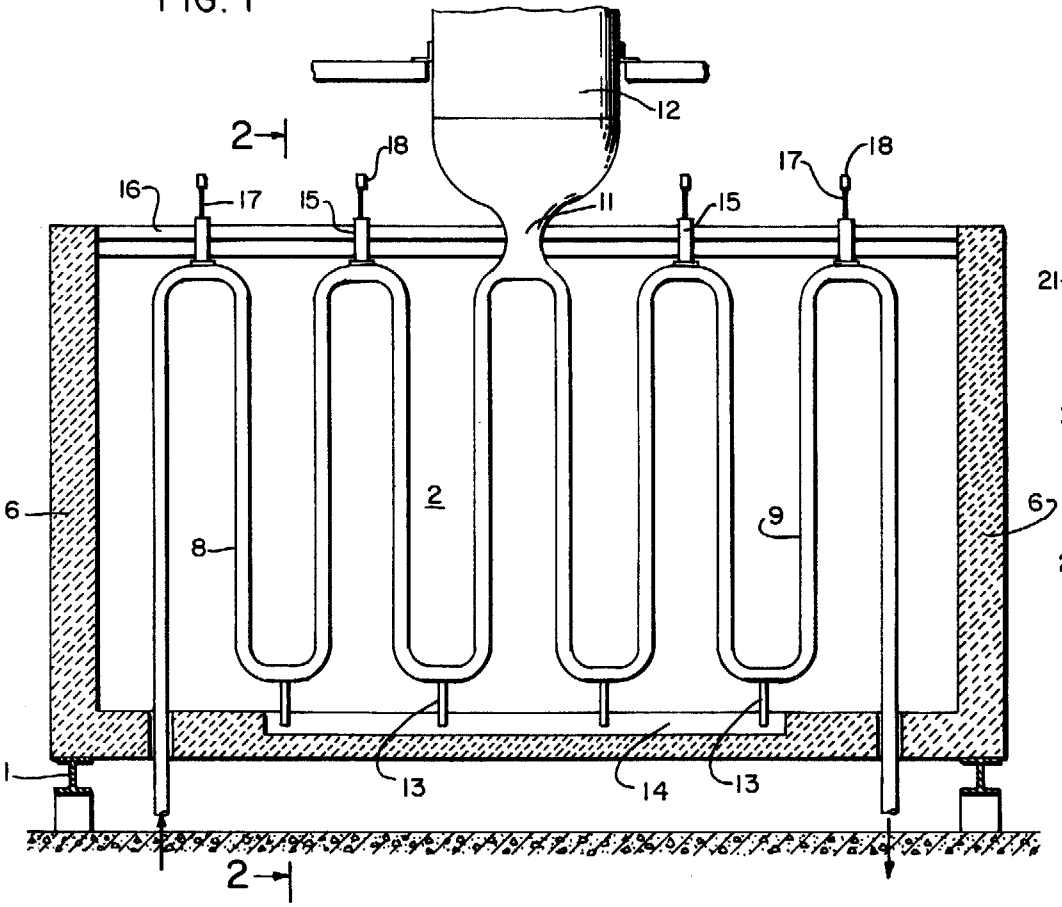

There is disclosed a tube heater supported by a structural steel frame 1. The heater is erected in accordance with normal furnace practice and includes walls 2 in which are located burners 3, a floor 4, a roof 5, and end walls 6. The products of combustion produced by the burners are exhausted through a duct 7 in the upper portion of one side wall to a stack, not shown. In this case there are shown two vertically positioned coils of tube 8 and 9 that are located midway between walls 2. Fluid is supplied to the coils to their outer ends from below the floor 4. Fluid leaves the tubes at a common point 11 into a connection on the lower end of a quench 12 that is mounted between its ends on a portion of frame 1 above the heater.

Each of the lower bends of each coil convolution has a short rod 13 welded to it. This rod extends loosely into a trough 14 formed in floor 4. Thus the lower bends of the coil may flex as required as the tube passes expand and contract, but are restrained by the sides of the trough from swinging toward or against sides 2 of the furnace.

The upper bends of each of the convolutions has welded to it a bar 15 that projects upwardly through a slot 16 formed in roof 5. The upper end of bar 15 is connected by a link 17 to one end of a lever 18 that is pivoted at 19. The other end of lever 18 supports a counterweight 21 sufficiently heavy to counterbalance the convolution of the coil to which it is attached.

Normally, the point where the outlet ends of the tubes connect to the inlet of the quench can be considered a fixed point of support. Actually, however, the lower end of the quench will move downwardly somewhat from its cold position when the heater is in operation to assume a position for a given temperature. This will adjust bodily the vertical position of both coils independently of any expansion of the tube passes. Such adjustment is permitted by counterweights 21.

When the furnace is in operation, fluid supplied to tubes 8 and 9, which is preheated, is brought up to its final temperature as it flows through the tubes before being discharged to quench 12. During the process temperature of the fluid gradually increases so that the various passes of the coil will reach different temperatures, thus causing different amounts of expansion. The individual supports for the upper bend of each coil convolution permit expansion as required. The lower bends of the coil convolutions are also free to move. Thus the coils can be moved bodily or the individual passes and convolutions can move freely with respect to each other.

Supporting the coils so that they are completely floating with each convolution free to move as it is required results in considerably less strain on the tube with a resulting longer life.

While in accordance with the provisions of the Statutes I have illustrated and described the best form of embodiment of my invention now known to me, it will be apparent to those skilled in the art that changes may be made in the form of the apparatus disclosed without departing from the spirit and scope of the invention set forth in the appended claims, and that in some cases certain features of my invention may be used to advantage without a corresponding use of other features.

What is claimed is:

1. A tube heater including structure forming a heating chamber having oppositely disposed side walls, a floor and a roof, said roof having a slot extending lengthwise thereof substantially midway between said side walls, burners to heat said chamber, a coil having vertically disposed convolutions located substantially midway between said side walls, a support having a vertically movable portion above said slot, one end of said coil extending through said slot and being fixedly attached to said movable portion, a bracket attached to the upper end of each convolution and extending through said slot, and movable means to support a convolution of the coil connected with each bracket whereby the coil is supported to move as a whole and with each convolution being able to move separately.

2. The combination of claim 1 in which said floor has a trough formed therein and extending lengthwise thereof substantially midway between said side walls, and a rod fixed to the lower end of each convolution of said coil and extending into said trough.

3. The combination of claim 1 in which there are provided a plurality of similar tube coils, each having one end attached to said vertically movable portion.

* * * * *